United States Patent [19]

Sadlack et al.

[11] Patent Number: 5,016,549

[45] Date of Patent: May 21, 1991

[54] ATTACHING A STRIP OF CLOTH WITH A ZIP-FASTENER COMPONENT TO A TROUSER FOREPART

[75] Inventors: Werner Sadlack, Bünde; Siegfried Vogt, Leopoldshöhe; Egon Upmeier, Lage; Wolfram Schulze, Bielefeld, all of Fed. Rep. of Germany

[73] Assignee: Kochs Alder Aktiengesellschaft, Fed. Rep. of Germany

[21] Appl. No.: 463,416

[22] Filed: Jan. 11, 1990

[30] Foreign Application Priority Data

Jan. 24, 1989 [DE] Fed. Rep. of Germany ..... 3901922

[51] Int. Cl.[5] ..... D05B 3/12; D05B 21/00

[52] U.S. Cl. ..... 112/104; 112/121.15; 112/113; 112/147; 112/265.2

[58] Field of Search ..... 112/113, 104, 121.12, 112/121.15, 147, 265.2; 2/265

[56] References Cited

U.S. PATENT DOCUMENTS

| | | | |
|---|---|---|---|
| 4,265,190 | 5/1981 | Moertel | 112/265.2 |
| 4,362,116 | 12/1982 | Gupta et al. | 112/265.2 |
| 4,534,067 | 8/1985 | Richardson | 2/234 |
| 4,541,352 | 9/1985 | Boser et al. | 112/265.2 |
| 4,602,580 | 7/1986 | Schramayr | 112/262 |
| 4,643,115 | 2/1987 | Jünemann | 112/121.12 X |
| 4,644,885 | 2/1987 | Bennison | 112/262 |
| 4,644,886 | 2/1987 | Miyakawa | 112/265.2 |
| 4,660,821 | 4/1987 | Boser et al. | 271/10 |
| 4,685,407 | 8/1987 | Junemann | 112/262 |
| 4,785,749 | 11/1988 | Fischer | 112/104 X |
| 4,793,272 | 12/1988 | Scholl et al. | 112/104 X |
| 4,809,627 | 3/1989 | Upmeier et al. | 112/113 X |
| 4,813,362 | 3/1989 | Vogt et al. | 112/113 X |
| 4,819,572 | 4/1989 | Scholl et al. | 112/121.15 |
| 4,821,658 | 4/1989 | Hiramatsu et al. | 112/114 |
| 4,869,185 | 9/1989 | Scholl et al. | 112/121.15 X |

OTHER PUBLICATIONS

Pfaff Special Service (Sep. 8, 1984), pp. 10–13.

*Primary Examiner*—Werner H. Schroeder
*Assistant Examiner*—Paul C. Lewis
*Attorney, Agent, or Firm*—Laff, Whitesel, Conte & Saret

[57] ABSTRACT

For the purpose of attaching a strip of cloth provided with a zip-fastener component to a trouser forepart, first a rim of the strip of cloth and then the rim of the trouser forepart are folded over. The strip of cloth is arranged above the trouser forepart. Both folded-over rims are brought into a position relative to each other which they occupy after being joined together. Then they are brought into mutual contact and joined together with only a single seam in only one sewing operation. Thus very simple handling of the parts to be sewn together is achieved along with a very simple design of the required sewing units.

14 Claims, 9 Drawing Sheets

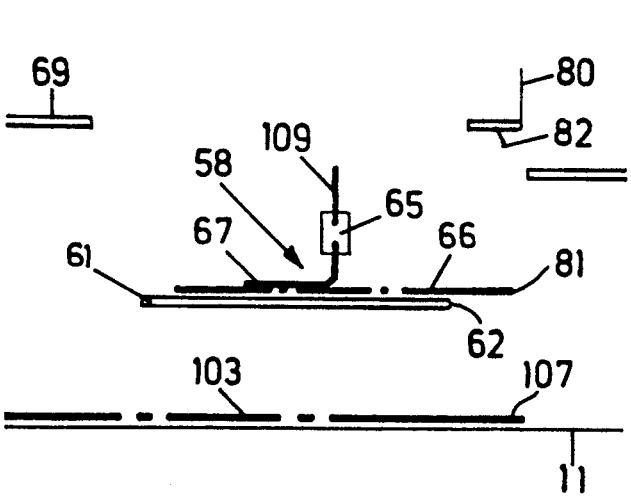
FIG. 13a
FIG. 13b
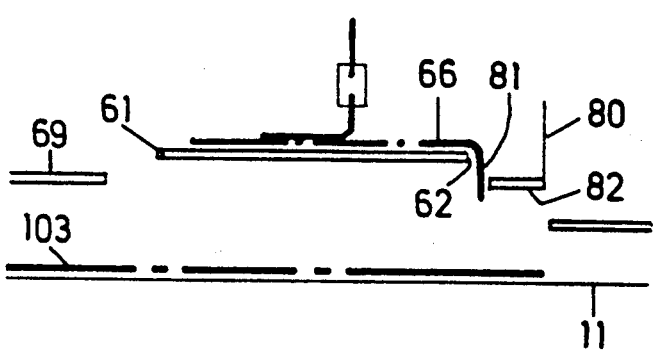
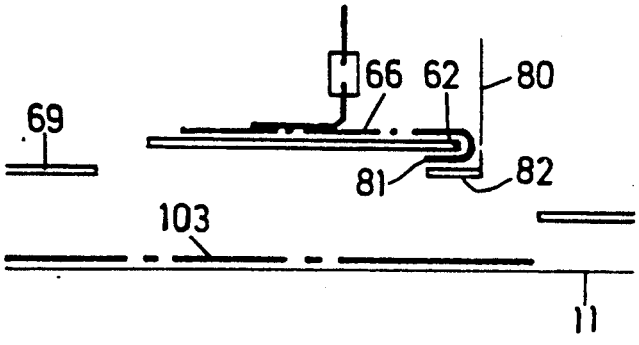
FIG. 13c
FIG. 13d
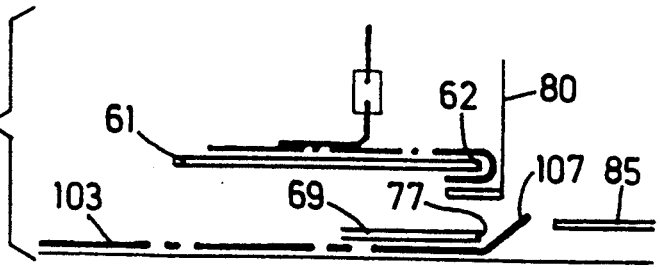

FIG.13e
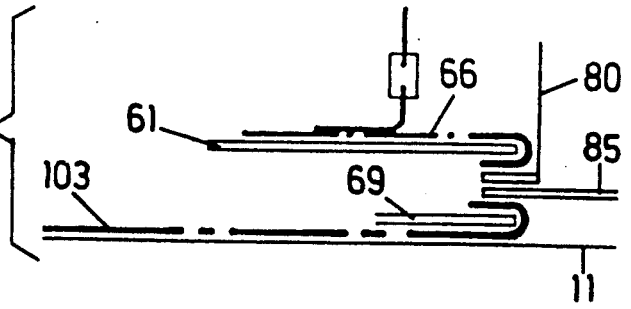
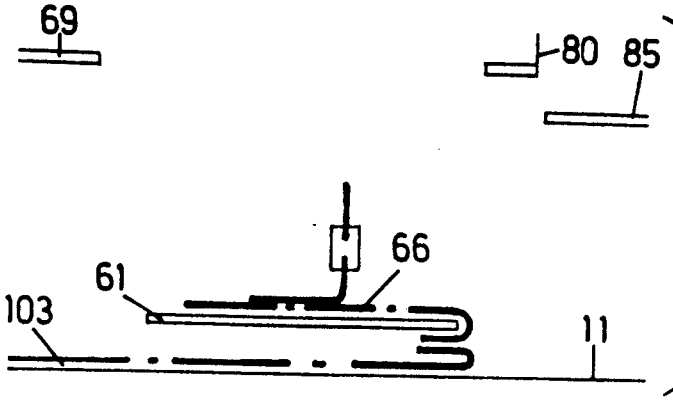
FIG.13f
FIG.13g
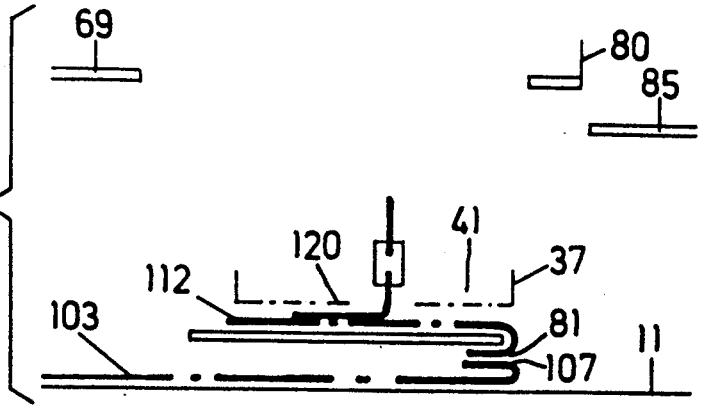
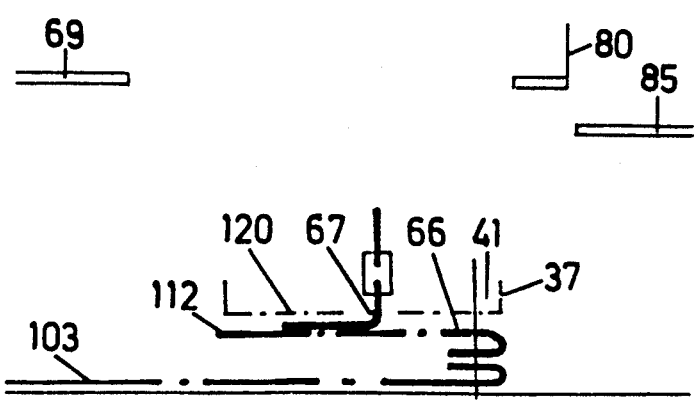
FIG.13h

ATTACHING A STRIP OF CLOTH WITH A ZIP-FASTENER COMPONENT TO A TROUSER FOREPART

FIELD OF THE INVENTION

The invention relates to the attaching of a strip of cloth provided with a zip-fastener component to one of two trouser foreparts, a rim of the trouser forepart being folded over and the strip of cloth being joined to the trouser forepart at least in the area of the folded-over rim by means of a seam and to a sewing unit for performing this operation comprising a sewing machine and a guiding device with a workpiece holder movable relative to the sewing machine.

BACKGROUND OF THE INVENTION

It is known practice from the publication of Pfaff Industriemaschinen GmbH entitled "PFAFF 200-04 Special Service" to sew together the associated strip of cloth on a left trouser forepart, the so-called left fly lining, and the associated area of the trouser forepart. The sewn-on strip of cloth is then folded over and the associated zip-fastener half, i.e. the left zip-fastener component, is sewn on. This strip of cloth is subsequently folded over again and the left joining seam is produced between the strip of cloth and the trouser forepart. Also, the sewing of the right strip of cloth having the right zip-fastener component, i.e. the associated zip-fastener half, on to the right trouser forepart takes place in several work cycles.

It is known practice from U.S. patent specification No. 4,534,067 to manufacture trouser flies in such a manner that an additional strip of cloth is also cut in one piece with each of the two trouser foreparts in the fly area and is then folded over and sewn together with the trouser forepart. In addition, a zip-fastener half, i.e. a zip-fastener component, is also sewn on. In the case of the left trouser forepart the outer edge is pressed inwards so that a four-layered design is formed in this case which is then stitched.

In the co-pending patent application Ser. No. 07/336,210 "Method of attaching a strip of cloth with a zip-fastener component to a trouser forepart and sewing unit for putting the method into practice" a method has been created which enables a strip of cloth with a zip-fastener component to be attached to a trouser forepart with the minimum possible work. In accordance with this invention this problem is solved by a method of bringing, in each case, one trouser forepart and a strip of cloth provided with a zip-fastener component by way of folding into their final form and into their final position relative to one another and by then sewing them together in a single operation. Manipulations of cloth layers to be carried out between several sewing operations are thus already avoided.

SUMMARY OF THE INVENTION

It is an object of the invention to further develop the known method.

It is a further object of the invention to embody a sewing unit in such a way that it is especially suitable for the performance of the method.

In accordance with the invention the first problem is solved by the features that, prior to the strip of cloth being joined to the trouser forepart, first a rim of the strip of cloth and then the rim of the trouser forepart are folded over, with the strip of cloth being arranged above the trouser forepart and with the folded-over rim of the trouser forepart and the folded-over rim of the strip of cloth being positioned relative to one another in a position which they occupy after being joined together, that the folded-over rims are brought into mutual contact, and that the joining by means of a seam is effected in a single sewing operation. The method according to the invention makes it possible that the big workpiece, namely a trouser forepart, lies beneath and that the strip of cloth with the zip-fastener component is placed on to the trouser forepart from above. This results in a substantially simplified manipulation while, at the same time, in particular, the possibility of control by the operator and the transition to sewing are considerably simplified and improved. The method according to the invention assures in particular the folding over and sewing up of a corner of a strip of cloth, whereby clean manufacturing is achieved on the one hand and fraying of the strip of cloth in this area is avoided.

The basic design of an especially suitable sewing unit according to the invention is characterized by a folding device comprising all the individual component devices for the performance of diverse folding operations. Thus a particularly clear and simple design is achieved. All these component devices may be supplied or removed in a single uniform movement. Only a zip-fastener reception to receive a strip of cloth provided with a zip-fastener component is still provided as a separate movable unit.

A plurality of further advantages and features of the invention will become apparent from the ensuing description of an exemplary embodiment, taken in conjunction with the drawings.

BRIEF DESCRIPTION OF THE DRAWINGS

FIG. 13*a* to *h* shows the operational sequence of the folding of the rims of the cloth strip and the trouser forepart, and of the subsequent sewing.

DESCRIPTION OF THE PREFERRED EMBODIMENT

Figure 1:
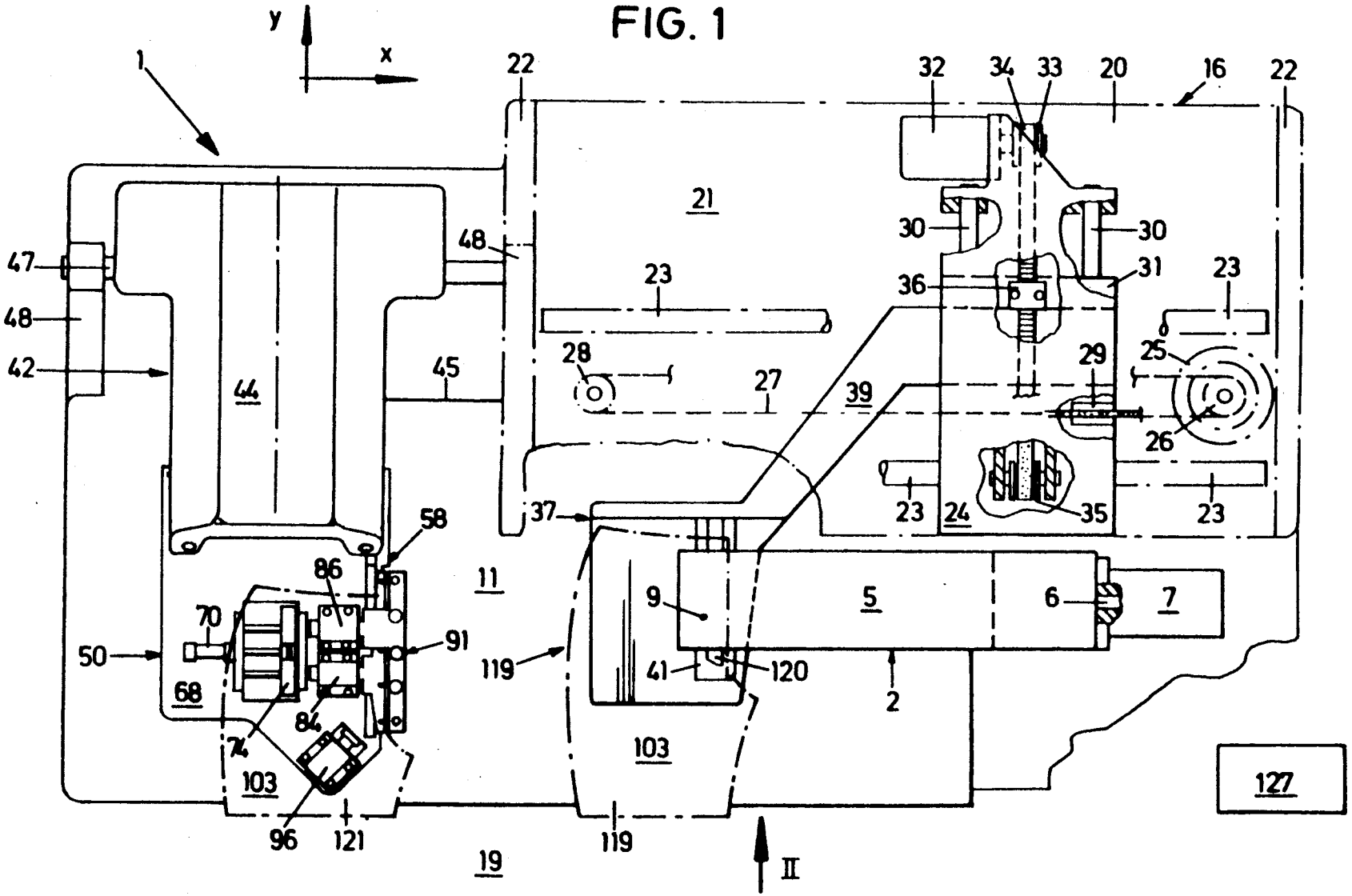
FIG. 1 is a plan view of a sewing unit.
Figure 2:
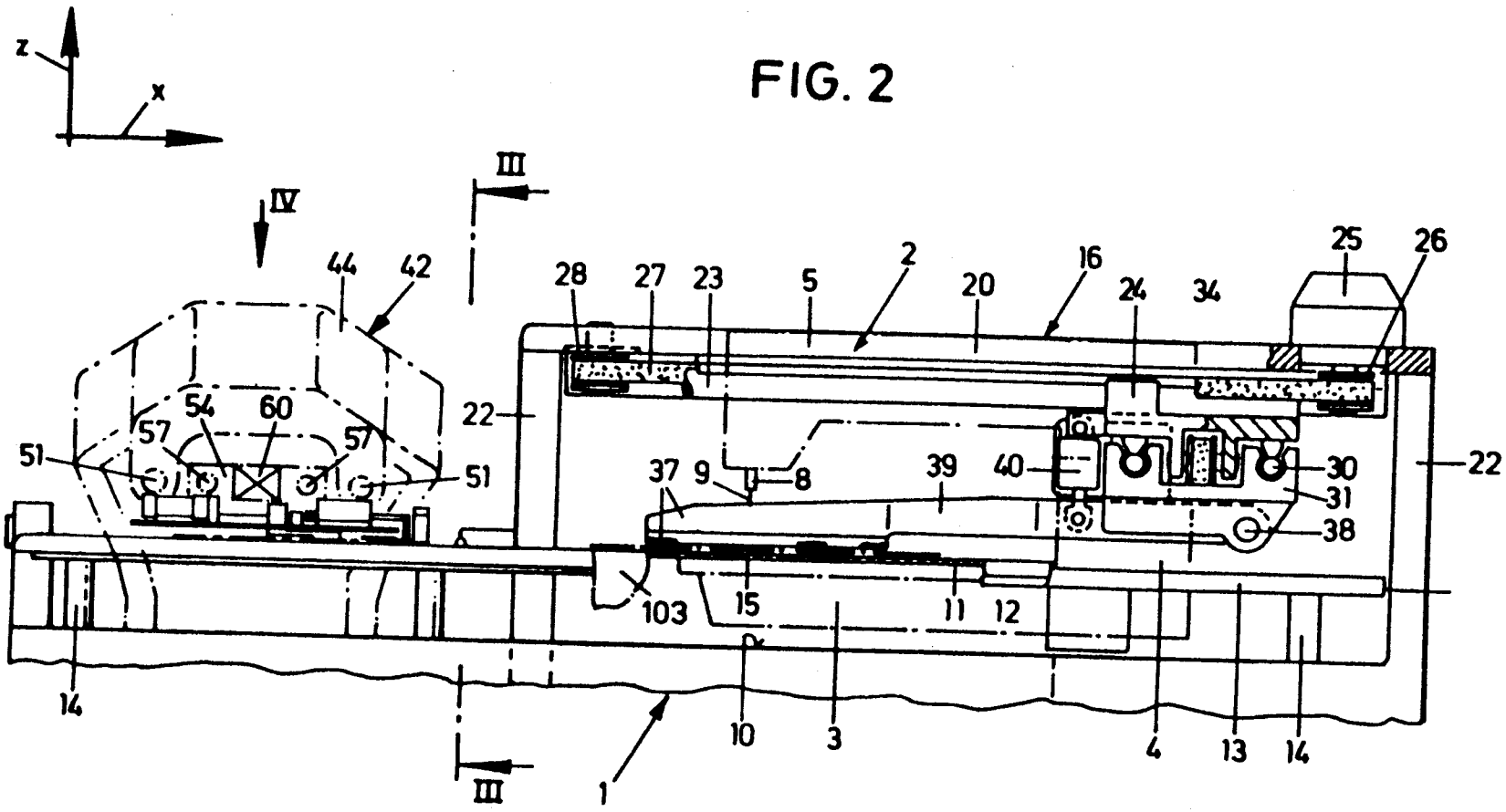
FIG. 2 is a front view of the sewing unit corresponding to the arrow II in FIG. 1.

The sewing unit, which is shown in FIGS. 1 and 2 and which in this case is an automatic sewing unit, has a stand 1 on which a sewing machine 2 is rigidly arranged. It consists in the customary manner of a base plate 3, a standard 4 and an upper arm 5. Mounted in the arm 5 of the sewing machine in the customary manner is an arm shaft 6 which can be driven by an electric sewing machine drive motor 7. The drive of a needle bar 8 and a needle 9 and, in addition, the drive of a hook (not shown in the drawing) situated in the base plate 3 are derived in the customary manner from the arm shaft 6. A bearing plate 11 with an upper side defining a sewing plane 12 is arranged on the stand 1 above the upper side 10 of the latter. This bearing plate 11 is supported—at least partly—on a supporting plate 13 which is supported on the stand 1 by way of supports 14. This bearing plate 11 is also supported on the base plate 3 of the sewing machine 2 and, in the path of movement of the needle bar 8 and needle 9 defined as the z direction, has a stitch hole 15 which permits the passage of the needle 9 to the hook.

Above the bearing plate 11 there is provided a guiding device 16 for guiding workpieces which are to be sewn together and will be explained in even more detail further on. The device is—when seen from the operator's side 19—arranged behind the sewing machine 2. It has an upper base plate 20 which, in the rearward area 21 of the stand 1 opposite the operator's side 19, is supported—as seen from the operator's side—behind the bearing plate 11 on the stand 1 by way of vertical supporting walls 22. Attached to the underside of this base plate 20 are guide rods 23 which run parallel to one another in the x direction and on which a carriage 24 is mounted so as to be slidable in the x direction. This carriage 24 is driven by an electric motor 25 which in this case can be a geared motor, via a timing belt pulley 26 and an endless timing belt 27. The motor 25 and the timing belt pulley 26 are supported on the base plate 20. A deflection pulley 28 is likewise mounted in the base plate 20. The timing belt 27, which is arranged below the base plate 20 between the guide rods 23 and runs parallel to the latter, is connected to the carriage 24 by means of a securing device 29 which in this case is a clamping device.

Mounted on the underside of the carriage 24, designated as the x carriage, is a further pair of guide rods 30 which run in the y direction, i.e. perpendicular to the x direction, and parallel to one another and on which a further carriage 31 is slidably guided in the y direction. This carriage 31 is therefore designated as the y carriage. Both carriages 24, 31 are therefore guided suspended from respective guide rods 23 and 30. The y carriage 31 is driven by way of an electric motor 32—which, if necessary, is likewise in the form of a geared motor—and is attached to the x carriage 24 in the rearward area 21. It has a timing belt pulley 33 from which the y carriage 31 is driven via an endless timing belt 34. The timing belt 34 is guided parallel to the guide rods 30 via a deflection pulley 35 mounted on the underside of the y carriage 31, and is secured to the underside of the y carriage by means of a securing device 36. The x and y directions are perpendicular to one another and perpendicular to the z direction. The x, y and z directions therefore form a standard cartesian coordinate system. The x and y directions are parallel to the sewing plane 12. The x direction runs parallel to the main longitudinal direction of the sewing machine 2, i.e. parallel to the arm shaft 6.

A workpiece holder 37 is mounted on the underside of the y carriage 31 so as to be pivotable about a tilt axle 38 running parallel to the y direction. For this purpose the workpiece holder 37 is attached to the end of an angle lever 39, the other end of which is mounted on the tilt axle 38. As shown in FIGS. 1 and 2, the angle lever 39 is bent twice, that is, firstly, away from the workpiece holder 37 in the y direction towards the rear area 21 and, secondly, upwards in the z direction from the bearing plate 11 towards the underside of the y carriage 31. Between the tilt axle 38 and the workpiece holder 37 there is provided a lift and press drive 40 which, on the one hand, engages on the angle lever 39 and, on the other hand, on the y carriage 31. The drive in this case is a linear drive which is, customarily, in the form of a pneumatically operatable piston-cylinder drive. As is evident from the preceding text, the entire guiding device 16 is arranged together with all the associated components above the bearing plate 11, and can therefore be arranged very close to the sewing machine 2. The workpiece holder 37 has at least one slot 41 which follows the course of at least one seam to be produced, by means of which the two workpieces are to be sewn together.

The sewing machine 2 and the guiding device 16 are associated with a preparatory station 42 in which the workpieces are brought into the position relative to one another necessary for sewing. The preparatory station 42 has a folding device 43 in which a workpiece, which in this case is a trouser forepart, is brought together, when folded and correctly positioned, with the second workpiece which in this case is a strip of cloth with a zip-fastener component which is also previously folded. This folding device 43 has a cover-like carrier 44 which is arranged above the bearing plate 11 and projects partly above the latter towards the rear side 45 of the stand 1, the rear side 45 meaning the side opposite the operator's side 19. At its rear end the carrier 44 has a downwardly projecting lever arm 46. In the area where it passes into the lever arm 46, the carrier 44 is mounted so as to be pivotable about a tilt axle 47 which extends in the x direction and is supported in two bearing arms 48 which are mounted on the rear side 45 of the stand 1 and project from the stand towards the rear side 45 and in an upward direction. Engaging on the lower end of the lever arm 46 is a tilt drive 49 which in this case is a pneumatically operable four-position piston-cylinder drive, and which therefore, apart from two end positions, can be positioned in two intermediate positions, as a result of which the carrier 44 and thus a trouser part and zip-fastener folding device 50 supported by this carrier can be positioned in four different tilt positions. The tilt drive 49 is supported on the rear side 45 of the stand 1.

Two guide rods 51 parallel to one another, which extend perpendicularly to the x direction and on each of which the folding device 50 is slidably guided by means of a sliding bearing 52 are arranged in the carrier 44. When the carrier 44 is in the upward and rearward pivoted position shown in FIG. 3, the guide rods 51 extend in the y direction approximately parallel to the bearing plate 11. A displacing drive 53 for the folding device 50, which drive engages on the slide bearings 52, is arranged on the carrier 44 above and between the guide rods 51. This displacing drive 53 is therefore a linear drive which, in this case, can be for example a pneumatic cylinder without a piston rod, as is commercially available under the name ORIGA. By means of this displacing drive 53 the folding device 50 can be brought into a position fully extended out of the carrier 44 towards the operator's side 19—as shown on the left side in FIG. 3—and into a position fully retracted into the carrier 44—as shown on the right side in FIG. 3.

Figure 3:
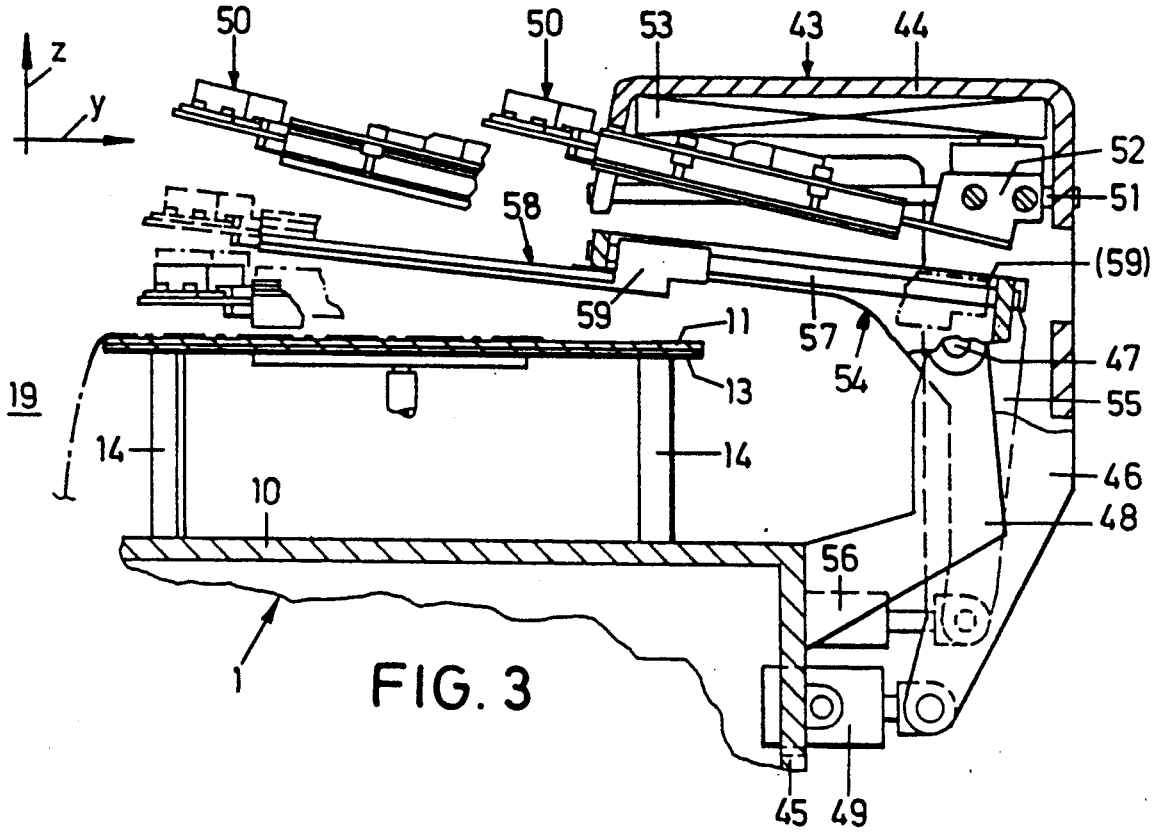
FIG. 3 is a cross-section through the sewing unit along the section line III—III in FIG. 2 which shows a partly broken-away side view of a preparatory station.

A zip-fastener receiving carrier 54, which is arranged essentially below the cover-like carrier 44 and particularly below the guide rods 51 with the sliding bearings 52, is likewise mounted pivotably on the tilt axle 47. At the rear end of this carrier 54 there is formed a downwardly extending arm 55 which is arranged essentially inside the lever arm 46. Engaging on the lower end of this arm 55 is a tilt drive 56 by means of which the zip-fastener receiving carrier 54 can be pivoted about the tilt axle 47. The tilt drive 56 is designed as a pneumatic three-position piston-cylinder drive, which can be positioned in positions corresponding to the three lower positions of the folding device 50. In the carrier 54 there are arranged—as can be seen in FIGS. 2 and 3—two guide rods 57 which are parallel to one another and extend essentially in the y direction and on which a reception 58 is mounted so as to be slidable by means of sliding bearings 59. The reception 58 is displaced by way of a reception displacing drive 60 which is arranged in the receiving carrier 54 and can be designed identically to the displacing drive 53. Displacement takes place between two end positions, of which the extended position is shown on the left in FIG. 3, whereas the retracted position is indicated on the right in FIG. 3 by a part of the sliding bearing 59 being represented by dot-dash lines.

The zip-fastener reception 58 has a bearing plate 61 which extends longitudinally essentially in the y direction and which is provided with a folding edge 62. A zip-fastener guiding rail 63 having a longitudinal slot in its bottom side facing the bearing plate 61 is arranged on the bearing plate 61 at a little distance only from the bearing plate 61. The guiding rail 63 provided as a U-profile or as a cut-open case profile serves to take up the toothed strip 65 of a zip-fastener component 67 sewn on a strip of cloth 66.

The folding device 50 has a bearing plate 68 on the bottom side of which a trouser sliding plate 69 is arranged, which is slidable in the x direction between two end positions by means of a sliding plate drive 70 arranged on the bearing plate 68. This drive 70 consists of a pneumatically operable two-position piston-cylinder drive, the cylinder 71 of which is supported on an abutment 72 arranged on the bearing plate 68, and the piston rod 73 of which is secured with its free end to a strip-shaped carriage 74. This carriage 74 is slidable on two parallel guiding rails 75 extending in the x direction, which are supported in the abutment 72, on the one hand, and in an end support 76, on the other hand. This carriage 74 projects cranked off through an opening **76*a* in the bearing plate 68 and bears the trouser sliding plate 69 below the bearing plate 68. The trouser sliding plate 69 is provided with a folding edge 77 running parallel to the folding edge 62 of the bearing plate 61 of the zip-fastener reception 58, which folding edge 77 is congruent with the folding edge 62 when the trouser sliding plate 69 is in an extended working position, as can be seen in particular in FIGS. 5 and 6. The cylinder 71 is connected to a source of compressed air not shown by way of compressed-air connections 78, 79**.

Figure 6:
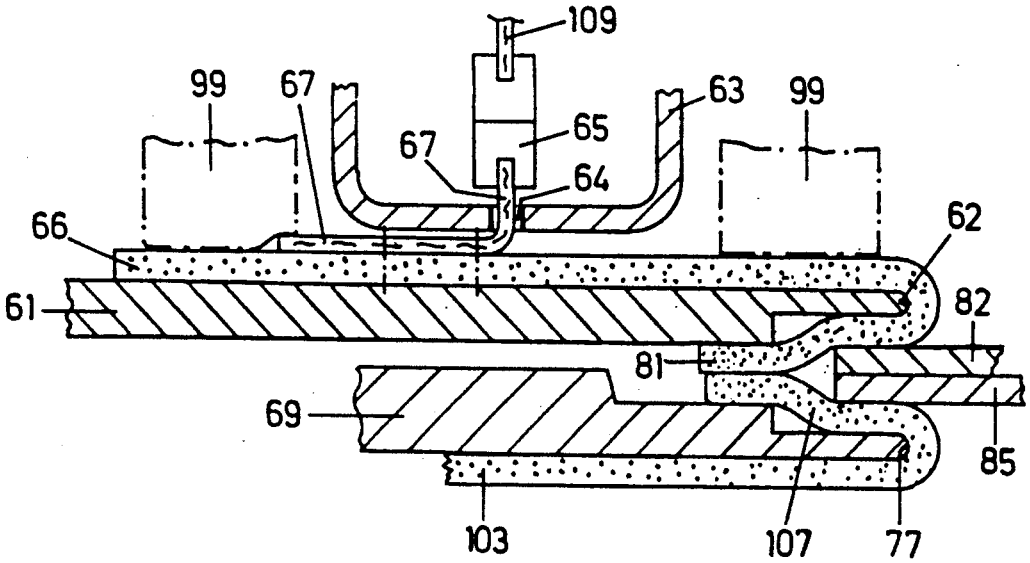
FIG. 6 shows, on a clearly enlarged scale, a detail of FIG. 5.
Figure 4:
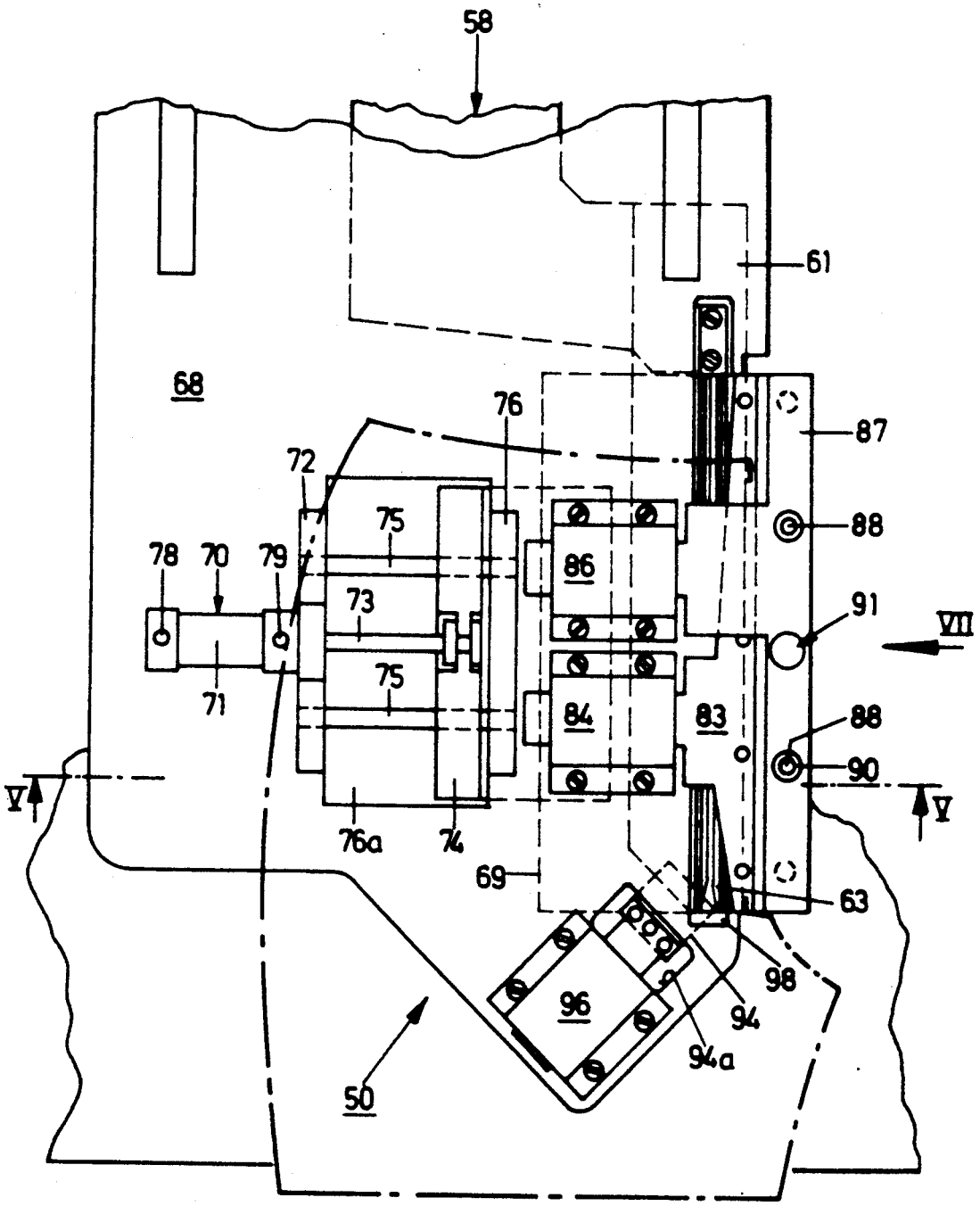
FIG. 4 is a plan view, on an enlarged scale, of a folding device in the direction of arrow IV in FIG. 3.
Figure 5:
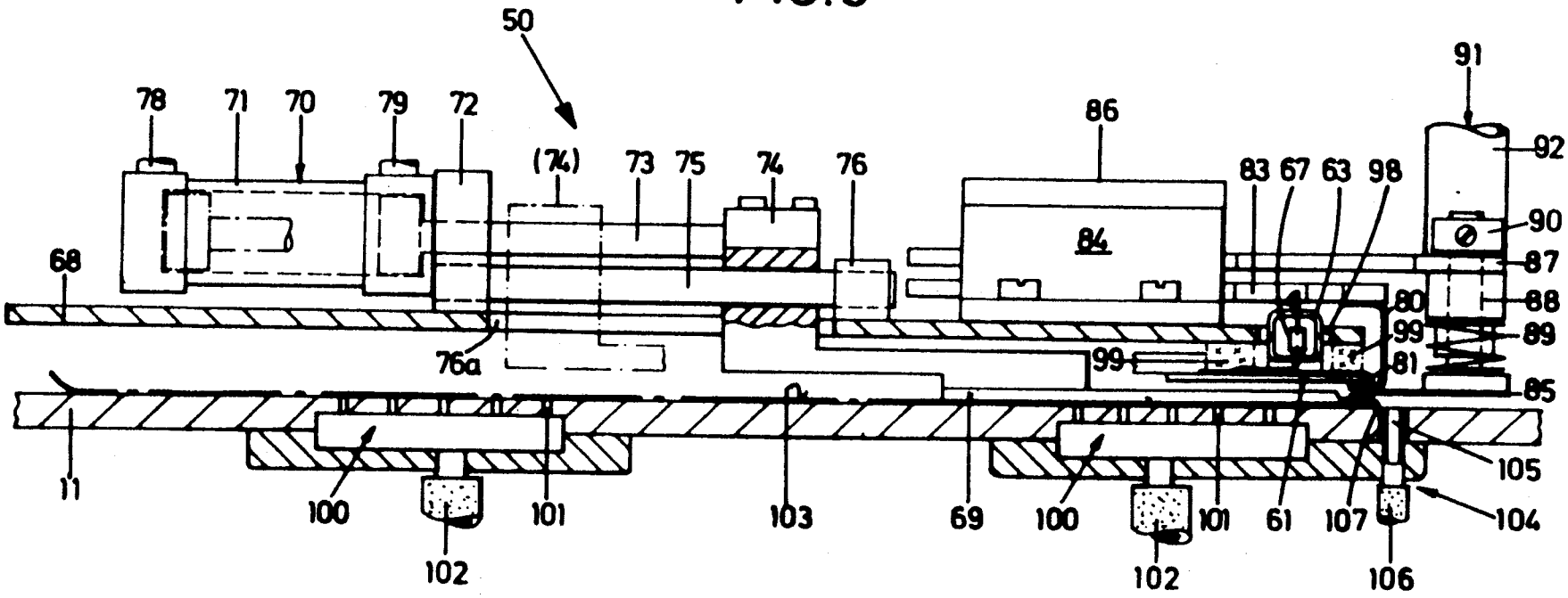
FIG. 5 is a cross-sectional view, in an enlarged view broken away several times, of the folding device along the section line V—V in FIG. 4.

Further, a cloth-strip side slider 80 is arranged on the bearing plate 68, by means of which slider 80 the rim 81 of the strip of cloth 66 sewn together with the zip-fastener component 67 is folded around the folding edge 62 of the bearing plate 61. This side slider 80 is about C-shaped, with its lower arm 82 sliding the rim 81 around the folding edge 62 (see FIGS. 5 and 6). The cloth-strip side slider 80 is connected with a pneumatically operatable displacing module 84 by means of a supporting bar 83. This pneumatically operatable displacing module 84 is movable between two end positions, in which the lower arm 82 of the cloth-strip side slider 80 either engages under the bearing plate 61—as shown in FIGS. 5 and 6—or in which both are free from one another, i.e. have been moved apart in the x direction.

Further, a trouser side slider 85 is provided at the bearing plate 68, which slider 85 is slidable between an inner and an outer end position equally by means of a displacing module 86. A supporting bar 87 extending further than the cloth-strip side slider 80 is secured to the displacing module 86. The trouser side slider 85 consisting of a flat and substantially rectangular plate is secured to the supporting bar 87 in a vertically slidable manner by means of two vertical guide rods 88. Pre-tensioned helical coil compression springs 89, which surround the guide rods 88 and by means of which power is exercised in downwards direction on the side slider 85, are provided between the supporting bar 87 and the side slider 85. The sliding path is limited by adjustable upper stops 90, which are secured to the guide rods 88 and which bear against the top side of the supporting bar 87.

A pressure drive 91 formed by a pneumatically operable piston-cylinder drive is arranged centrally between the two guide rods 88 at the supporting bar 87. The cylinder 92 of this drive is secured to the supporting bar 87 and its piston rod 93 can be moved out downwards towards the side slider 85, whereby, in the moved-out end position of the piston rod 93, the side slider 80 is fixed or blocked in its lower position relative to the supporting bar 87, in which position the stops 90 bear against the supporting bar 87. Alternatively the side slider 80 is fixed in a position in which it is downwards arrested. The pressure drive 91 cannot lift the bearing plate 68 upwards against the force of the tilt drive 49.

Figure 9:
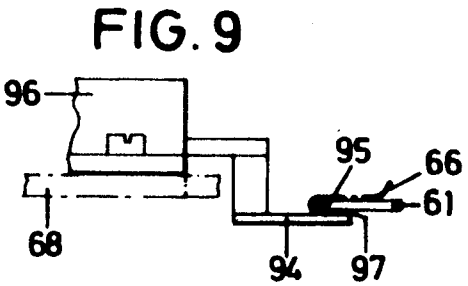
FIG. 9 is a partial side view of the cloth-strip corner slider in the direction of arrow IX in FIG. 8.
Figure 8:
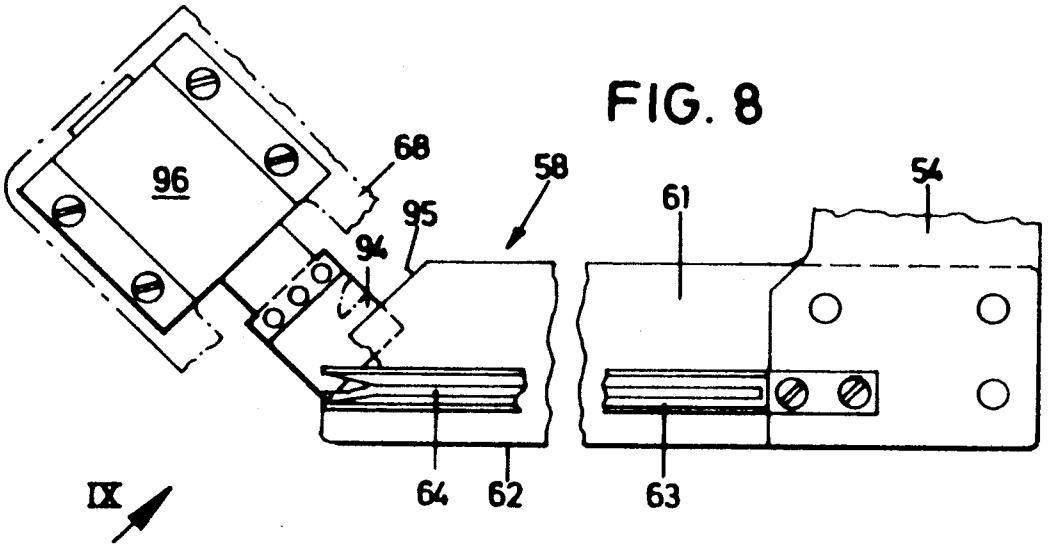
FIG. 8 is a partial plan view of the folding device showing a cloth-strip corner slider.
Figure 7:
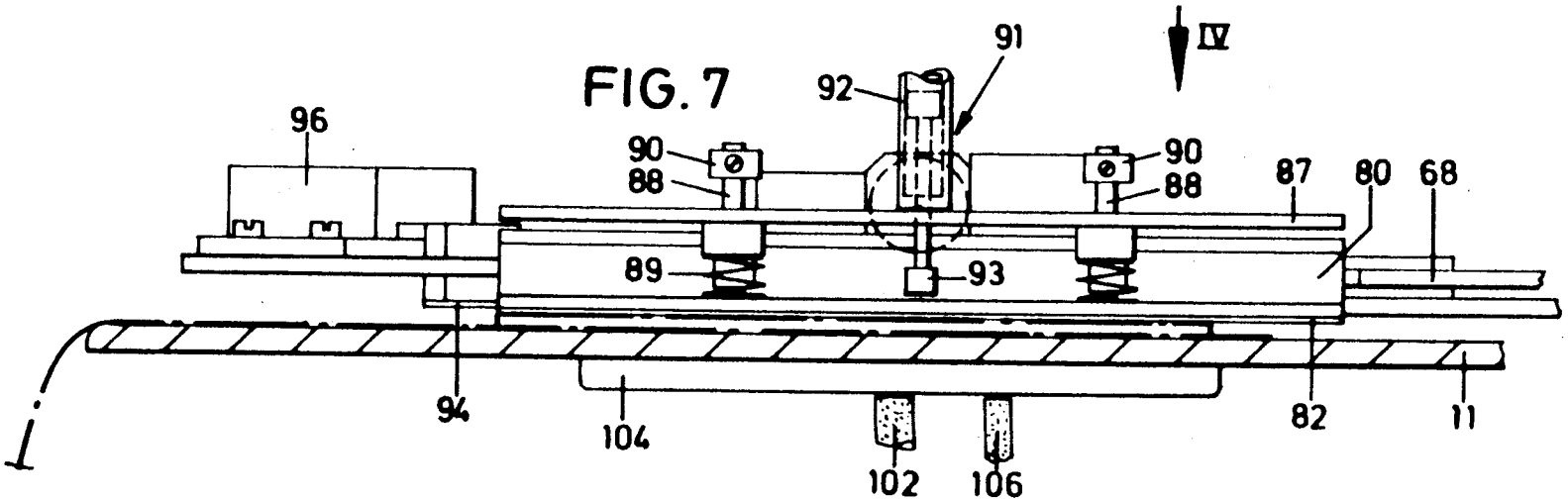
FIG. 7 is a partial side view of the folding device in the direction of arrow VII in FIG. 4.

A cloth-strip corner slider 94 is provided below the bearing plate 68 and is slidable at an angle of about 45° relative to the x direction and the y direction, namely in cooperation with a cloth-strip corner folding edge 95 provided at the bearing plate 61. The corner slider 94, too, is slidable between two end positions by means of a displacing module 96 arranged on the bearing plate 68. In FIG. 8 the moved-out position is shown. It passes through an opening **94*a* in the bearing plate 68. In the position shown in FIGS. 8 and 9 the corner slider 94 has been moved under the folding edge 95, thus folding over a corner 97 of the strip of cloth 66—according to FIG. 9. All displacing modules 84, 86, 96** are pneumatically operatable and commercially available.

The bearing plate 68 has a recess 98 for receiving the zip-fastener guiding rail 63 so that the bearing plate 68 may also be lowered via the latter. On both sides of the recess 98 resilient bars 99, made for example of foamed rubber, are secured to the bottom side of the bearing plate 68, bear on the strip of cloth 66, which is held in the zip-fastener reception 58 and lies on the bearing plate 61, and press it on to the bearing plate 61.

Suction devices 100 are provided in the bearing plate 11 having suction openings 101 leading to the top side of the bearing plate 11. They are connected with a vacuum source not shown by means of one vacuum line 102 in each case. Thus sewing workpieces such as a trouser forepart 103, once positioned, can be held in this position on the bearing plate by means of underpressure.

A blowing device 104 is arranged adjacent to the folding edge 77 of the touser sliding plate 69, namely when the latter is in its moved-out working position, and is connected with the top side of the bearing plate 11 by way of blowing openings 105. It is connected with a source of compressed air not shown by means of a compressed-air pipe 106. The rim 107 of the trouser forepart 103 associated with the folding edge 77 can be lifted by means of this blowing device 104.

Figure 11:
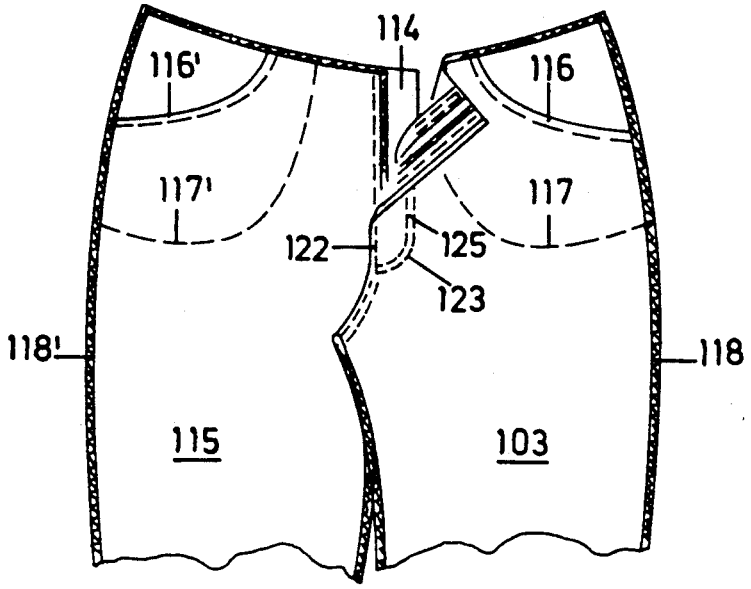
FIG. 11 is a plan view of sewn-together trouser foreparts having a fly.
Figure 10A:
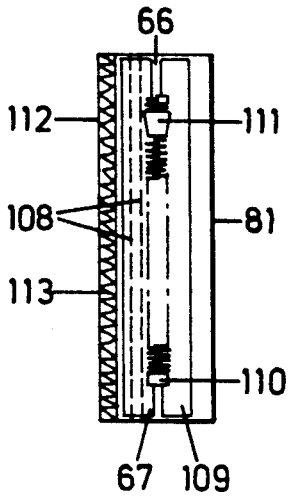
FIG. 10*a* and *b* are plan views of a cloth strip provided with a complete zip-fastener or of cloth strips continuously sewn together with a zip-fastener component.
Figure 12:
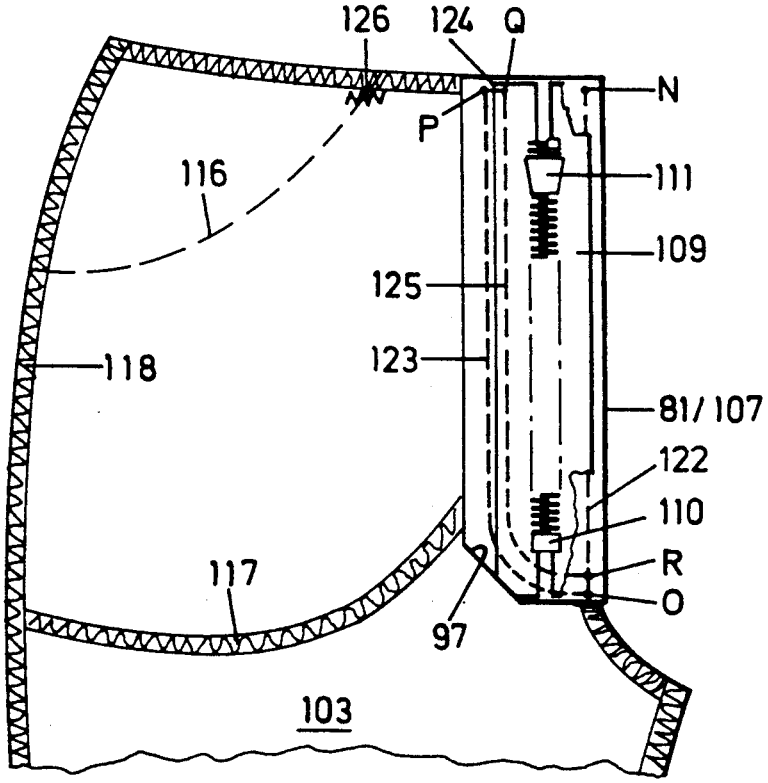
FIG. 12 shows a left trouser forepart in a finally sewn state.
Figure 10B:
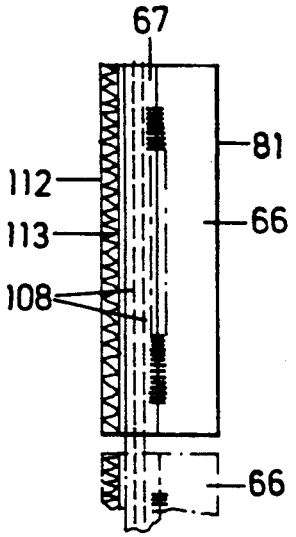

Prior to a detailed explanation of the mode of operation of the described sewing unit and of the method thus applied the basic problems of sewing technique are outlined with the help of FIG. 10 to 12. A left strip of cloth 66 is shown, on to which a left zip-fastener component 67 is sewn with a double seam 108. On the one hand, this can be realized in such a way that the left zip-fastener component 67 has already been connected with a right zip-fastener component 109, i.e. it has a stop 110 and a slider 111, as shown in FIG. 10*a* and FIG. 12. On the other hand, it is also possible to sew endless left zip-fastener components 67 on left cloth-strips 66 by means of the double seam 108 and to separate them before they are further processed, which still remains to be described. This is shown in FIG. 10*b*. The rim 112 of the cloth strip 66 which is not to be folded over, i.e. which is opposite the rim 81, has been provided with a finishing seam 113.

The left strip of cloth 66 with the left zip-fastener component 67 or the whole zip-fastener, respectively, also designated as fly lining or fly strip, is to be sewn into the left trouser forepart 103. The sewing in or sewing on, respectively, of the right zip-fastener component 109 with a right strip of cloth 114 to a right trouser forepart 115 is not described. After being sewn together the let trouser forepart 103 and the right trouser forepart 115 form a pair of foretrousers shown in FIG. 11 which, after connection with the two trouser hindparts not shown, makes a total pair of trousers.

The two trouser foreparts 103 and 115 are provided with pocket mouths 116, 116' and pocket pouches 117, 117'. Along their longitudinal edges the trouser foreparts 103, 115 are substantially finished by means of finishing seams 118, 118'.

In the following the sewing of a left strip of cloth 66 with a left zip-fastener component 67 to a left trouser forepart 103 is described and whenever the left strip of cloth 66 is mentioned, this means a left strip of cloth with an associated zip-fastener component 67.

In the start position of the preparatory station 42 the folding device 50 and the zip-fastener reception 58 are in their position facing away from the operator's side 19 towards the rear side 45.

First, the left trouser forepart 103 is put on the bearing plate 11, where it is aligned for example by means of marks on the bearing plate 11. The suction device 100 is put into operation so that the trouser forepart 103 is held where it has been positioned. Then the zip-fastener reception 58 is moved in its position towards the operator's side 19, namely in its upper position as shown in FIG. 3 in solid lines, by actuation of the displacing drive 60. The left strip of cloth 66 is introduced in the zip-fastener reception 58, so that it rests on the bearing plate 61, while the zip-fastener component 67 is pulled through the longitudinal slot 64 of the guiding rail 63. This position is shown in FIG. 13*a*.

Then the bearing plate is moved out in its upper position towards the operator's side 19 as shown in FIG. 3 top left. It is at a distance above the zip-fastener reception 58. Then the bearing plate is lowered into its middle position, i.e. into its upper intermediate position, by corresponding actuation of the tilt drive 49, as shown in FIG. 3 middle left. Thus the lower arm 82 of the cloth-strip side slider 80 takes a position below the bearing plate 61 folding the rim 81 of the strip of cloth 66 around the folding edge 62 as shown in FIG. 13*b*. Then compressed air is admitted to the displacing module 84 of the cloth-strip side slider 80 such that the lower arm 82 of the latter is drawn under the bearing plate, so that the rim 81 of the strip of cloth 66 is folded around the folding edge 62 of the bearing plate 61 a shown in FIG. 13*c*. At the same time the cloth-strip corner slider 94 is moved out by corresponding actuation of the displacing module 96, so that the corner 97 of the strip of cloth 66 is folded over around the cloth- strip corner folding edge 95 of the bearing plate 61.

Then the trouser sliding plate 69 is moved in the direction towards the trouser side slider 85 by corresponding actuation of the drive 70, so that the folding edge 77 of the trouser side slider 85 takes a position below the folding edge 62 of the bearing plate 61. Then the bearing plate 68 and the zip-fastener reception 58 are lowered to take in an intermediate position closely above the bearing plate 11 by corresponding actuation of the tilt drives 49, 56, as shown in FIG. 13*a*. Thus the trouser sliding plate 69 comes into contact with the trouser forepart 103 lying on the bearing plate 11. Further, compressed air is admitted to the pressure drive 91, so that the trouser side slider 85 is fixed in it slower position relative to the bearing plate 68. The compressed air is admitted to the blowing device 104, so that the rim 107 of the trouser forepart 103 is blown upwards, i.e. it is lifted, as shown in FIG. 13*d*.

Then the displacing module 86 of the trouser side slider 85 is actuated by compressed air in such a way that the rim 107 of the trouser forepart 103 is folded around the folding edge 77 of the trouser sliding plate 69. The flowing device 104 is switched off. By means of corresponding actuation of the tilt drives 49, 56 the bearing plate 68 and the zip-fastener reception 58 are brought into their lowest position. This position is shown in FIG. 13*a*. After lowering of the bearing plate 68 and the zip-fastener reception 58 the piston rod 93 of the pressure drive 91 is relieved, i.e. the trouser side slider 85 is no longer fixed.

The trouser side slider 85 now takes a position in which the stops 90 no longer bear on the supporting bar 87, as indicated in FIG. 5. They are lifted off the supporting bar 87 by about the dimension of the cloth thickness of the rim 107.

By means of a corresponding inverse actuation of the drive 70 the trouser sliding plate 69 is retracted. Further, the displacing module 86 is actuated in such a way that the trouser side slider 85 is again moved outwards. Then the displacing modules 84 and 96 are actuated in such a way that the cloth-strip side slider 80 and the cloth-strip corner slider 94, respectively, are again moved out of their folding-over position. Now all parts located at the bearing plate 68 are free of the trouser forepart and the strip of cloth 66. The bearing plate 68 can be tilted upwards into its uppermost position by a corresponding actuation of the tilt drive 49. The zip-fastener reception 58, however, still rests in its lower position, as can be taken from FIG. 13*f*. The workpiece holder 37, which might as well be designated as a transfer plate, is still in a sewing position 119 under the sewing machine 2. By moving the y carriage 31 and simultaneously actuating the lift and press drive 40 the workpiece holder 37 is moved in the direction towards the operator's side 19 and then lifted off, so that a finished workpiece, namely the trouser forepart 103, may be taken away. Then the workpiece holder 37 is moved towards the preparatory station 42 by moving the x carriage, i.e. over the folded trouser forepart 103 with the folded strip of cloth 66. By means of an inverse actuation of the lift and press drive 40 the workpiece holder is lowered on to the folded trouser forepart 103. The slot 41 of the workpiece holder is so dimensioned that it may take up the zip-fastener guiding rail 63 of the zip-fastener reception 58. A resilient pressure bar 120 projects into the slot 41 and bears against the strip of cloth 66 in the area between the folded-over rim 81 and the guiding rail 63.

Then the zip-fastener reception 58 is moved into its rear position, i.e. in the direction towards the rear side 45, by a corresponding actuation of the reception displacing drive. The trouser forepart 103 and the strip of cloth 66 with the zip-fastener component 67 now are only held between the workpiece holder 37 and the bearing plate 11. By a corresponding moving of the x carriage 24 and of the y carriage 31 the trouser forepart 103 and the strip of cloth 66 are moved out of the transfer position into the sewing position 119 under the sewing machine 2.

There, proceeding from a seam starting point N in an upper outer corner N, the strip of cloth 66 and the trouser forepart 103 are sewn together along the folded-over rims 81, 107 in a straight-line seam 122 to a lower outer seam point O. From there the area of the rim 112 of the strip of cloth 66 is sewn by means of a J-shaped seam 123 to an upper inner seam point P, with the corner 97 of the strip of cloth 66 and the trouser forepart 103 being sewn in. Then a short seam 124 is sewn in the direction towards the seam starting point N to a point Q and from there a J-seam 125 parallel to the J-seam 123 is sewn to a seam end point R of the seam 122. Then the section from R to Q is sewn once again.

As can be taken from the above-outlined, the sewing of the trouser forepart 103 is done from behind, i.e. the sight seam lying outwards according to FIG. 11 is formed by the looper thread of the sewing machine 2, while the seam lying inwards in FIG. 12 is formed by the needle thread.

The sewing of the described seams may still be followed by the sewing of further seams on the trouser forepart 103—if the workpiece is designed to this effect. For example, the pocket pouch 117 may be secured by a seam block 126.

In order to avoid slipping of the trouser forepart 103 and the strip of cloth 66 with the zip-fastener component 67 positioned on the forepart 103 during movement by means of the guiding device 16 on the bearing plate 11 relative to the workpiece holder 37 serving as a transfer plate, the latter is provided in usual manner with adhesion means such as foamed rubber strips or the like on its side facing the trouser forepart 103.

For the purpose of automatization of the work cycles described, a computer 127 is provided, by means of which the various drives are triggered in sequence after an initial triggering by the operator.

What is claimed is:

1. A sewing unit for attaching a strip of cloth provided with a zip-fastener component (67) to one trouser forepart (103) of two trouser foreparts (103, 115) comprising:

a sewing machine (2); and a guiding device (16) with a workpiece holder (37) movable relative to the sewing machine;

wherein a preparatory station (42) is provided comprising:

a bearing plate (11) extending to the sewing machine (2) and provided with holding devices for the trouser forepart (103), a zip-fastener reception (58) for receiving and positioning a strip of cloth (66) provided with the zip-fastener component (67) relative to a folding edge (62), and a folding device (50), comprising a cloth-strip side slider (80) slidable between two end positions for folding a rim (81) of the strip of cloth (66) over the folding edge (62), a trouser sliding plate (69), slidable between two end positions and having a folding edge (77), and a trouser side slider (85) slidable between two end positions for folding a rim (107) of the trouser forepart (103) over the folding edge (77) of the trouser sliding plate (69);

wherein the zip-fastener reception (58) and the folding device (50) are movable above one another and on to one another;

and wherein the guiding device (16) is formed for a common transport to the sewing machine (2) of the trouser forepart (103) and the strip of cloth (66) both positioned relative to each other.

2. A sewing unit according to claim 1, wherein the folding device (50) has a common bearing plate (68), on a bottom side of which are arranged the trouser sliding plate (69), a part (82) of the cloth-strip side slider (80) serving to fold over the rim (81) of the strip of cloth (66), and the trouser side slider (85); and wherein displacing drives (70, 84, 86) for the trouser sliding plate (69), the cloth-strip side slider (80) and the trouser side slider (85) are arranged on a top side of the bearing plate (68).

3. A sewing unit according to claim 2, wherein the trouser side slider (85) is arranged below the said part (82) of the cloth-strip side slider (80) serving to fold over the rim (81) of the strip of cloth (66).

4. A sewing unit according to claim 2, wherein the trouser side slider (85) is guided to slide perpendicular to the bearing plate (11) in guide rods (88) provided at the bearing plate (68).

5. A sewing unit according to claim 4, wherein the trouser side slider (85) is pressable in a direction towards the bearing plate (11) by means of a pressure drive (91).

6. A sewing unit according to claim 2, wherein the zip-fastener reception (58) is arranged below the bearing plate (68).

7. A sewing unit according to claim 1, wherein the zip-fastener reception (58) comprises a zip-fastener guiding rail (63) with a longitudinal slot (64) for the zip-fastener component (67) for positioning the strip of cloth (66) relative to the folding edge (62).

8. A sewing unit according to claim 1, wherein the holding device for the trouser forepart (103) is formed by a suction device (100) in the bearing plate (11).

9. A sewing unit according to claim 1, wherein a blowing device (104) is provided in the bearing plate (11) to blow up the rim (107) of the trouser forepart (103) around the folding edge (77) of the trouser sliding plate (69).

10. A sewing unit according to claim 2, wherein a cloth-strip corner slider (94) is provided at the bottom side of the bearing plate (68) for folding a corner (97) of the strip of cloth (66) over a folding edge (95) of the zip-fastener reception (58), wherein the cloth-strip corner slider (94) is slidable between two end positions by means of a displacing drive arranged on the top side of the bearing plate (68).

11. A sewing unit according to claim 7, wherein the bearing plate (11) continuously extends from a transfer position (121) in the preparatory station (42) to a sewing position (119) at the sewing machine (2);

wherein the guiding device (16) has a workpiece holder (370) to be placed on to the trouser forepart (103) and the strip of cloth (66); and wherein a common transfer of the trouser forepart (103) and the strip of cloth (66) from the transfer position (121) to the sewing position (119) takes place by means of the workpiece holder (37) on the bearing plate (11).

12. A sewing unit according to claim 11, wherein the workpiece holder (37) has a slot (41) to partially overlap the zip-fastener reception (58).

13. A sewing unit according to claim 1, wherein the folding device is pivotable between four positions of height, namely an upper position, a middle position, a lower position bearing against the bearing plate (11) and an intermediate position between the middle position and the lower position.

14. A sewing unit according to claim 13, wherein the zip-fastener reception (58) is pivotable between three positions corresponding to the middle position, the intermediate position and the lower position of the folding device (50).

* * * * *